US008091150B2

(12) United States Patent
Bengochea

(10) Patent No.: US 8,091,150 B2
(45) Date of Patent: Jan. 10, 2012

(54) BATTING HELMET

(76) Inventor: Omar Bengochea, Waco, TX (US)

( * ) Notice: Subject to any disclaimer, the term of this patent is extended or adjusted under 35 U.S.C. 154(b) by 654 days.

(21) Appl. No.: 12/292,333

(22) Filed: Nov. 17, 2008

(65) Prior Publication Data

US 2009/0126062 A1 May 21, 2009

Related U.S. Application Data

(60) Provisional application No. 60/996,466, filed on Nov. 19, 2007.

(51) Int. Cl.
*A42B 3/04* (2006.01)

(52) U.S. Cl. ..... 2/425; 2/15; 2/422

(58) Field of Classification Search ..... 2/455, 410, 2/422, 423, 425, 15, 10
See application file for complete search history.

(56) References Cited

U.S. PATENT DOCUMENTS

| | | | | |
|---|---|---|---|---|
| 3,067,427 | A | 12/1962 | McClintock, Sr. | |
| 3,495,273 | A * | 2/1970 | Aileo | 2/6.4 |
| 3,685,054 | A | 8/1972 | Raschke | |
| 4,432,100 | A * | 2/1984 | Bates | 2/424 |
| 4,605,226 | A | 8/1986 | Morrissey | |
| 4,677,694 | A | 7/1987 | Crow | |
| 4,885,806 | A | 12/1989 | Heller | |
| D309,512 | S | 7/1990 | Crow | |
| 5,263,204 | A | 11/1993 | Butsch | |
| 5,394,564 | A * | 3/1995 | Rodriguez | 2/9 |
| 5,521,653 | A * | 5/1996 | Anderson | 351/45 |
| 5,966,744 | A * | 10/1999 | Smith, Jr. | 2/424 |
| 6,390,619 | B1 | 5/2002 | Gill, Jr. | |
| 2004/0214147 | A1 | 10/2004 | Robinson | |
| 2005/0015867 | A1 | 1/2005 | Emanuel | |
| 2007/0109492 | A1 | 5/2007 | Abraham | |
| 2008/0000016 | A1 * | 1/2008 | Kellogg | 2/410 |

FOREIGN PATENT DOCUMENTS

| | | |
|---|---|---|
| JP | 2000245888 | 9/2000 |

* cited by examiner

*Primary Examiner* — Christopher Harmon
(74) *Attorney, Agent, or Firm* — Richard C. Litman

(57) ABSTRACT

The batting helmet is a training helmet having an extendable panel on each side of the helmet. Each panel is slidably mounted in a hollow case or sheath attached to the ear flap and extends forward from the ear flap at eye level. The panel is extendable in discrete increments, preferably to three different lengths, to offer a greater or lesser degree of restriction of the batter's field of vision according to the batter's skill level. In order to accomplish incremental extension, the panel has a resilient tab or button that locks into one of a plurality of slots defined in the case to lock the panel at the desired length. The panel restricts the batter's vision to focus the batter's attention on the pitched ball, often requiring the batter to turn his head to see the ball leave the pitcher's hand and follow its flight.

16 Claims, 4 Drawing Sheets

BATTING HELMET

CROSS-REFERENCE TO RELATED APPLICATION

This application claims the benefit of U.S. Provisional Patent Application Ser. No. 60/996,466, filed Nov. 19, 2007.

BACKGROUND OF THE INVENTION

1. Field of the Invention

The present invention relates to sports teaching devices. In particular, the present invention relates to a batting helmet with adjustable side panels used to teach concentration by restricting an athlete's vision.

2. Description of the Related Art

Referred to as America's national pastime, the sport of baseball has been around for over one hundred fifty years. One of the hardest skills to teach a young player is how to hit a baseball. Considering the size of a baseball and the speed it may travel, the batter must focus on the trajectory of the ball in order to make contact. To accomplish this, the batter must keep his eye the ball, maintaining his concentration during the flight of the ball. This can be difficult for novice hitters, who may become distracted by looking at the position or movement of the defensive players, or by other distractions within his field of vision, or who tries to rely upon peripheral vision to follow the flight of the pitched ball.

Commonly, batters tend to turn their head and look away from the baseball prior to swinging the bat. In such a case, the player has already lost proper striking form, lost swinging power, and will either swing blindly or rely on his or her peripheral vision. Ultimately, this action will reduce the likelihood that the player will make solid contact with the baseball.

Thus, a batting helmet solving the aforementioned problems is desired.

SUMMARY OF THE INVENTION

The batting helmet is a training helmet having an extendable panel on each side of the helmet. Each panel is slidably mounted in a hollow case or sheath attached to the ear flap and extends forward from the ear flap at eye level. The panel is extendable in discrete increments, preferably to three different lengths, to offer a greater or lesser degree of restriction of the batter's field of vision according to the batter's skill level. In order to accomplish incremental extension, the panel has a resilient tab or button that locks into one of a plurality of slots defined in the case to lock the panel at the desired length. The panel restricts the batter's vision to focus the batter's attention on the pitched ball, often requiring the batter to turn his head to a greater or lesser degree to see the ball leave the pitcher's hand and follow its flight.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
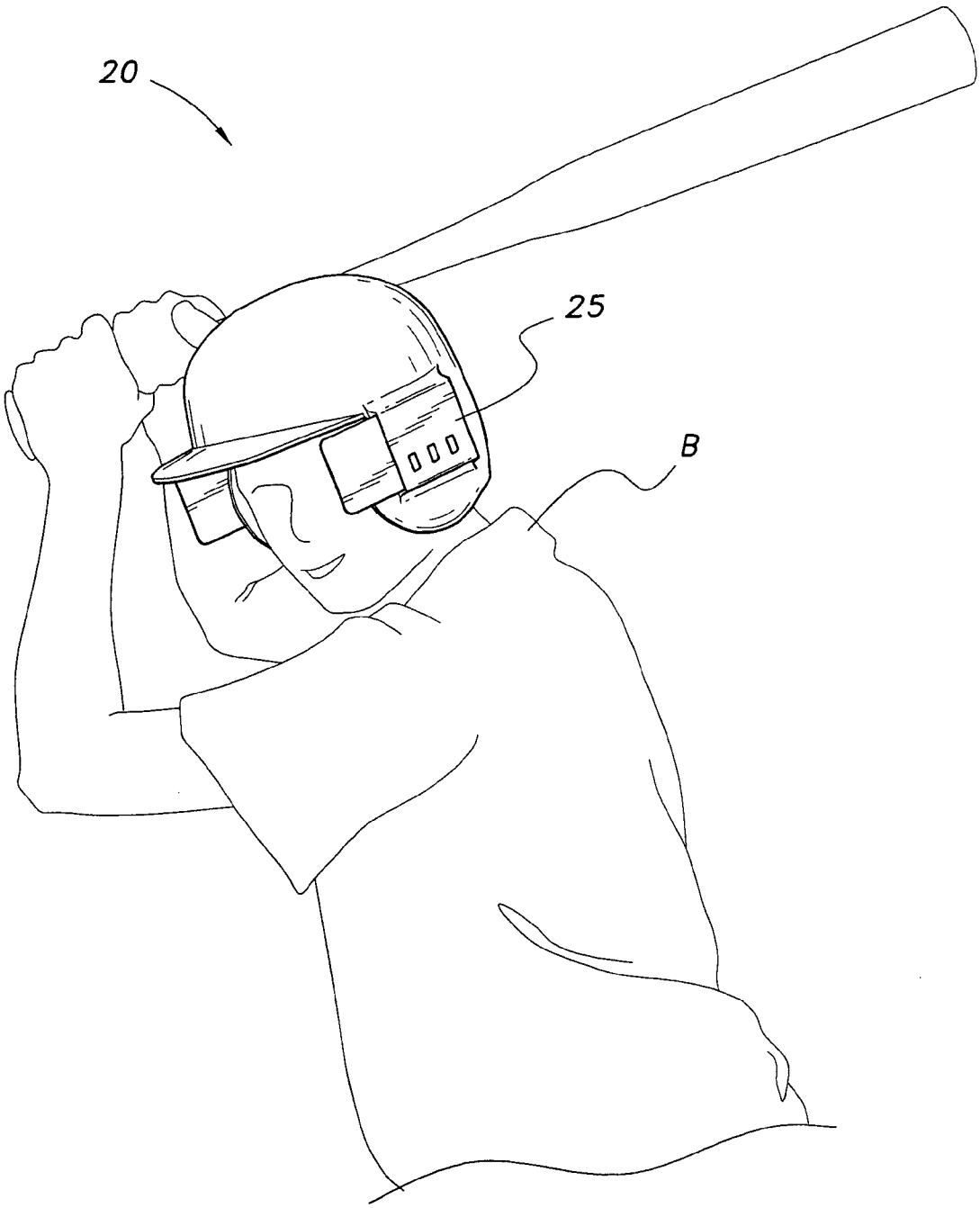
FIG. 1 is an environmental perspective view of a batting helmet according to the present invention, showing the panels in an extended position.

As shown in FIG. 1, the present invention relates to a batting helmet 20 used to train novice baseball players B (and rehabilitate more advanced players who have developed bad habits or poor form when batting) to focus their vision on the flight of a pitched ball when batting. The batting helmet 20 is made from a rigid material to protect the batter's head and has an eye shield or blinder 25 that restricts a batter's peripheral vision and forces the player B to turn toward the pitcher to a greater or lesser degree in order to follow the path of the ball from the moment it leaves the pitcher's hand.

Figure 2:
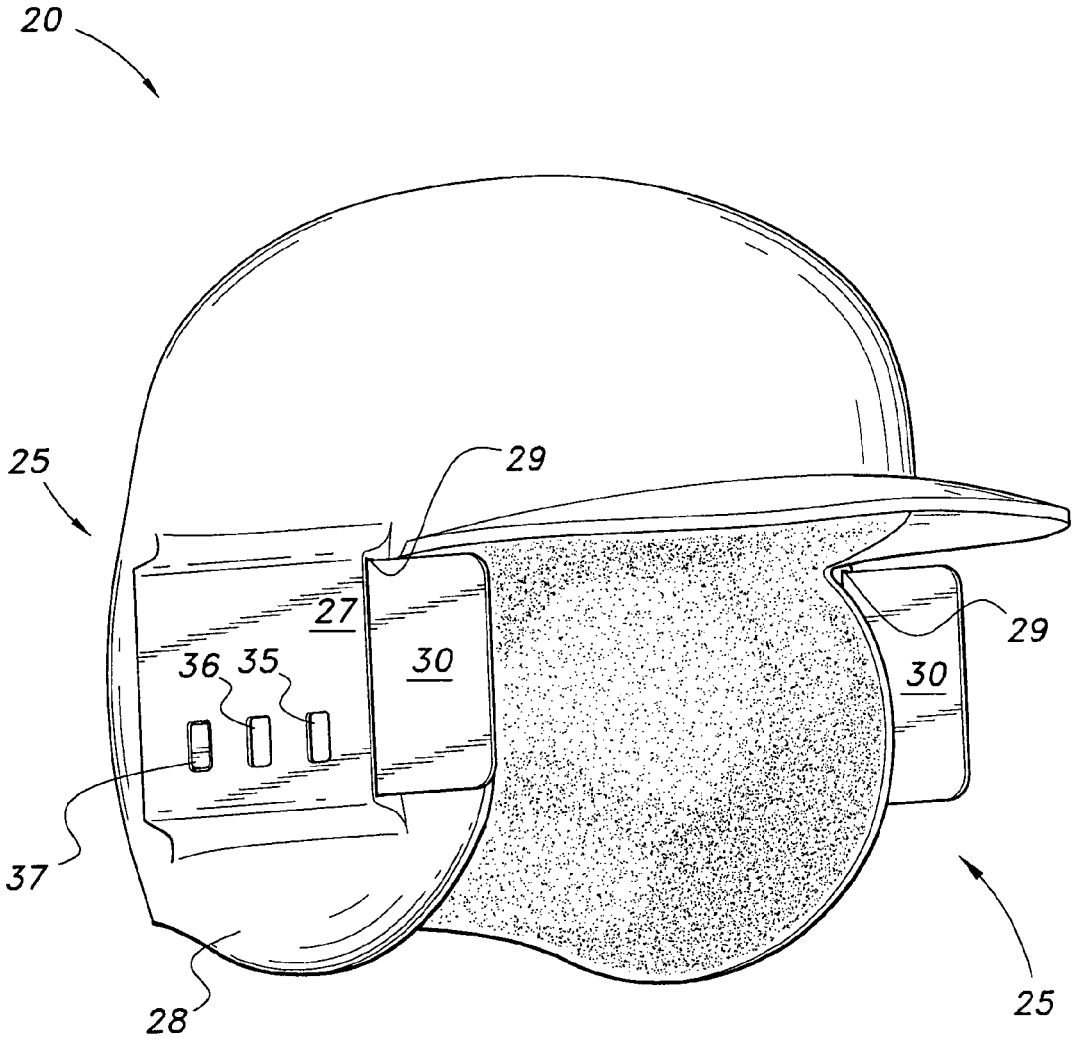
FIG. 2 is a perspective view of a batting helmet according to the present invention, showing the panels in a retracted position.
Figure 3:
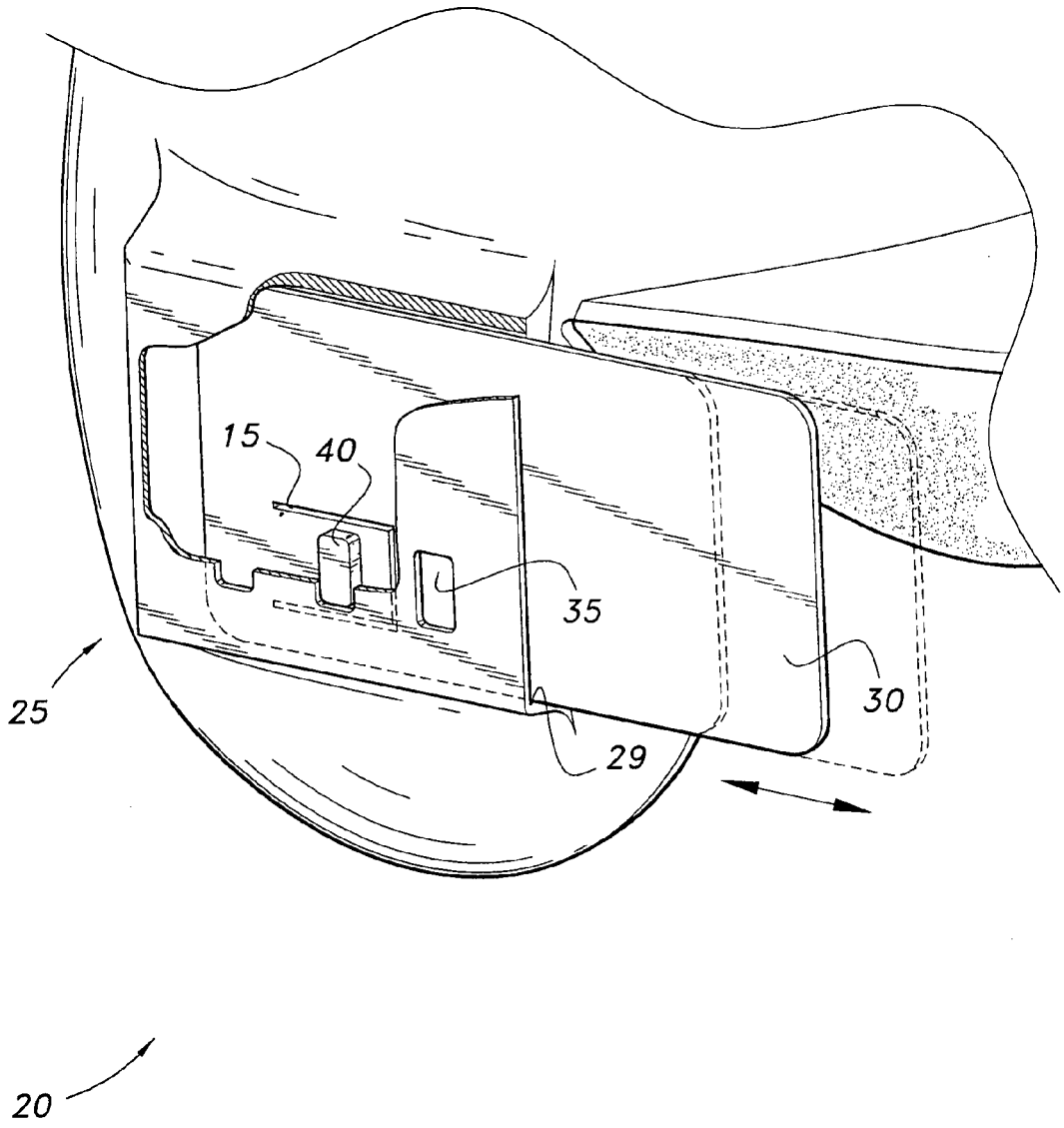
FIG. 3 is a perspective view of the side panel, partially broken away, to show the blinder communication according to the present invention.

Referring to FIG. 2, the blinder 25 includes a case 27 formed on the ear flap 28 of the helmet 20 that defines a track 29. The outer wall of the case 27 has a plurality of openings formed therethrough, preferably in the form of three slots 35, 36, and 37, extending from front to back. It should be understood that any suitable number of slots may be formed through the outer wall of case 27. The blinder 25 also includes an opaque panel 30 that slides in the track 29 so that the panel 30 is extendable forward of the ear flap 28, generally at eye level, in order to restrict the peripheral vision of the player B when batting, as best shown in FIG. 3. The panel 30 may be composed of any suitable material, and is preferably formed from a shatterproof and opaque material, such as polycarbonate, polypropylene, or the like. Preferably, panels 30 are removable such that the batting helmet may be provided with a set of removable and replaceable panels 30. When a panel 30 wears out or is broken, it may be removed and replaced with a fresh panel.

Typically, batting helmets used in the major league have a single ear flap on the side of the helmet that faces the pitcher (the left side for right-handed batters, and the right side for left-handed hitters) to protect the side of the batter's face facing the pitcher. Batting helmets used in the minor leagues and in amateur baseball (such as colleges, high schools, and Little League, for example), are typically required to have an ear flap on both sides of the helmet. Although the drawings show a batting helmet 20 having an ear flap 28 on both sides and a blinder 25 on both ear flaps 28, it will be understood that the batting helmet 20 may have a single ear flap 28 and a single blinder 25, which would be formed on the single ear flap 28, without departing from the spirit or scope of the present invention.

Figure 4A:
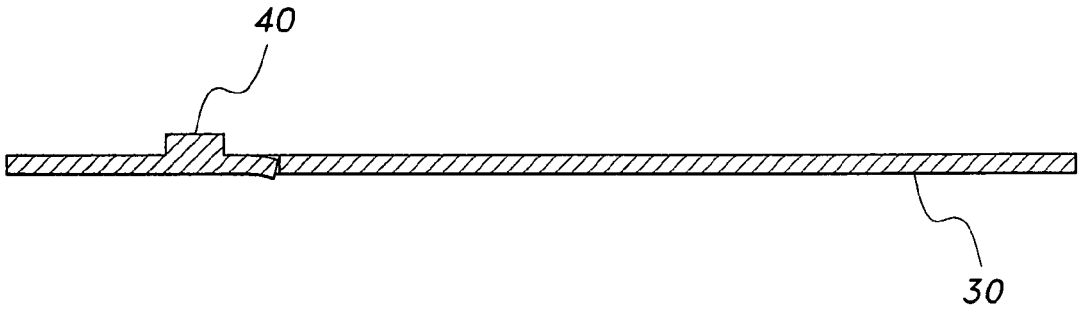
FIG. 4A is a diagrammatic section view of an extendable panel of a batting helmet according to the present invention, shown detached from the case and showing alignment of the resilient tab with the body of the panel when the tab is in a locked position.
Figure 4B:
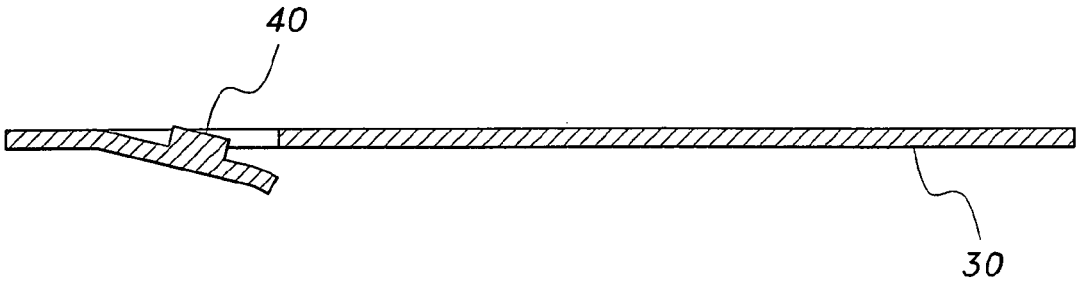
FIG. 4B is a diagrammatic section view of an extendable panel of a batting helmet according to the present invention, shown detached from the case and showing alignment of the resilient tab with the body of the panel when the tab is in an unlocked position.

As shown in FIGS. 3, 4A, and 4B, the panel 30 has a resilient tab or button 40 mounted thereon. As shown in FIG. 4A, the resilient tab 40 is normally biased so that the tab or button 40 protrudes from the plane of the panel 30. However, when the panel 30 is slidably disposed in the track 29, the wall of the case 27 bends the tab 40 back into the track 29, as shown in FIG. 4B. The bending of tab 40 from the plane of panel 30 is accomplished through the mounting of tab 40 on a flap 15, defined in the panel 30, so that the panel 30 slides in the track 29 until the tab 40 is aligned with one of slots 35, 36, 37. The resilience of the tab 40 causes the flap 15 to realign with the panel 30 and the tab 40 to snap into the selected slot 35, 36, 37, as shown in FIGS. 3 and 4A, locking the panel 30 in an extended position at a length determined by the position of the slot 35, 36, or 37. When it is desired to unlock the panel 30 to slide the panel 30 forward or backward, the user presses the tab 40 far enough into the track 29 to permit sliding the panel 30 forward or backward.

In use, the panel 30 is extended to its forwardmost position by locking tab 40 into forward slot 35 for novice hitters. The forwardmost position restricts the batter's peripheral vision the most, and may cause the player B to turn his head almost 90° to see the ball leaving the pitcher's hand. The player B will not be able to turn his head quickly towards the plate, but must do so gradually to continue to follow the flight of the pitch, thereby training the hitter to rely upon natural instincts to time his swing and match the level of the swing to the height of the ball as it crosses the plate. As the player B gains more experience and improved timing, the position of the panel may be retracted to a more intermediate position by snapping button 40 into middle slot 36, permitting a greater field of peripheral vision to view the defense, and to a more rearward position by snapping button 40 into rear slot 37 to further increase the field of vision.

It is to be understood that the present invention is not limited to the embodiments described above, but encompasses any and all embodiments within the scope of the following claims.

I claim:

1. A batting helmet, comprising:

a helmet adapted for protecting a batter's head, the helmet having at least one ear flap;

a case mounted on the ear flap, the case defining a track;

a panel slidably disposed in the track, the panel being slidable to an extended position forward of the ear flap in order to selectively restrict the batter's vision of a pitched ball; and means for locking the panel in the extended position.

2. The batting helmet as recited in claim 1, wherein said case is hollow, the track being defined within an open interior region of said case.

3. The batting helmet as recited in claim 2, wherein said case is mounted on an external surface of the ear flap.

4. The batting helmet as recited in claim 2, wherein said case has an outer wall having at least one slot formed therethrough, said means for locking the panel in the extended position comprising a tab mounted on the panel, the tab releasably engaging the at least one slot.

5. The batting helmet as recited in claim 4, wherein said panel has a pivotal flap formed thereon, the tab being formed on the pivotal flap.

6. The batting helmet as recited in claim 4, wherein the at least one slot comprises a plurality of slots extending along a lateral direction, the panel being slidable within said case along the lateral direction, whereby the batter selectively engages the tab with one of the plurality of slots to extend the panel to a selected length.

7. A batting helmet, comprising:

a helmet adapted for protecting a batter's head, the helmet having at least one ear flap;

a case mounted on the ear flap, the case defining a track, the case having an outer wall having at least one slot defined therein;

a panel slidably disposed in the track, the panel being slidable to an extended position forward of the ear flap in order to restrict the batter's vision of a pitched ball; and a resilient tab mounted on the panel, the tab being compressible into the track to permit sliding the panel and spring-biased to snap into the at least one slot in order to lock the panel in the extended position.

8. The batting helmet as recited in claim 7, wherein said case is hollow, the track being defined within an open interior region of said case.

9. The batting helmet as recited in claim 8, wherein said case is mounted on an external surface of the ear flap.

10. The batting helmet as recited in claim 7, wherein the at least one slot comprises a plurality of slots extending along a lateral direction, the panel being slidable within said case along the lateral direction, whereby the batter selectively engages the tab with one of the plurality of slots to extend the panel to a selected length.

11. A peripheral blinder for a batting helmet, comprising:

a case adapted for mounting on an ear flap of a batting helmet, the case defining a track;

a panel slidably disposed in the track, the panel being slidable to an extended position forward of the ear flap in order to selectively restrict a batter's vision of a pitched ball; and means for locking the panel in the extended position.

12. The peripheral blinder for a batting helmet as recited in claim 11, wherein said case is hollow, the track being defined within an open interior region of said case.

13. The peripheral blinder for a batting helmet as recited in claim 12, wherein said case is adapted for mounting on an external surface of the ear flap.

14. The peripheral blinder for a batting helmet as recited in claim 12, wherein said case has an outer wall having at least one slot formed therethrough, said means for locking the panel in the extended position comprising a tab mounted on the panel, the tab releasably engaging the at least one slot.

15. The peripheral blinder for a batting helmet as recited in claim 14, wherein said panel has a pivotal flap formed thereon, the tab being formed on the pivotal flap.

16. The peripheral blinder for a batting helmet as recited in claim 14, wherein the at least one slot comprises a plurality of slots extending along a lateral direction, the panel being slidable within said case along the lateral direction, whereby the batter selectively engages the tab with one of the plurality of slots to extend the panel to a selected length.

* * * * *